US007280781B2

(12) United States Patent
Willis

(10) Patent No.: US 7,280,781 B2
(45) Date of Patent: Oct. 9, 2007

(54) OVERRIDE OF STACK LIMIT SETTINGS

(75) Inventor: Keith Lamar Willis, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 301 days.

(21) Appl. No.: 11/088,439

(22) Filed: Mar. 24, 2005

(65) Prior Publication Data

US 2006/0216054 A1 Sep. 28, 2006

(51) Int. Cl.
*G03G 15/00* (2006.01)

(52) U.S. Cl. ..... 399/81; 399/407

(58) Field of Classification Search ..... 399/79, 399/81, 403, 405, 407; 271/207, 288, 290, 271/292, 293, 298
See application file for complete search history.

(56) References Cited

U.S. PATENT DOCUMENTS 3,856,125 A * 12/1974 Post ..... 192/127
4,044,232 A * 8/1977 Hubbard ..... 377/8
4,927,131 A 5/1990 Hashimoto et al.
5,500,715 A * 3/1996 Ta et al. ..... 399/1
5,551,686 A * 9/1996 Sanchez et al. ..... 271/298
5,715,381 A * 2/1998 Hamilton ..... 358/1.15
6,176,480 B1 1/2001 Yonenuma et al.
6,408,147 B1 6/2002 Oshida
6,666,444 B1 12/2003 Paoli
6,669,386 B1 12/2003 Myers et al.
6,744,527 B1 6/2004 Dorsey et al.
6,748,186 B1 6/2004 Skrainar et al.

FOREIGN PATENT DOCUMENTS

JP 06258885 A * 9/1994

* cited by examiner

*Primary Examiner*—Robert Beatty
(74) *Attorney, Agent, or Firm*—Maginot, Moore & Beck

(57) ABSTRACT

A user interface is provided for a printer having a finishing device having a maximum physical sheet capacity and being operable at an operational sheet capacity equal to or less than the maximum physical sheet capacity, a marking device which applies marks to sheets of media supplied thereto and outputs the same to the finishing device which receives the sheets from the marking device. The user interface comprises a display and an input device. The display communicates to an operator of the printer a selectable operational capacity of the finishing device whereby the operator may select a selectable operational capacity, a selectable option to override the selectable operational capacity and a prompt to override the operational capacity. The input device permits the operator of the printer to indicate selections.

19 Claims, 13 Drawing Sheets

OVERRIDE OF STACK LIMIT SETTINGS

BACKGROUND AND SUMMARY

This disclosure relates to printers with finishers and more particularly to printers with finishers that can have the capacity of the finisher limited to below the physical capacity of the finisher through user input.

In the case of copiers, printers and the like (hereinafter all referred to generally as printers), it is often advantageous to provider users thereof with a way to monitor the printer's operations and/or available resources. For example, a user may desire to know how may sheets of paper or other medium are in a particular sheet feeder which supplies the sheets to the printer. Similarly, a user may desire to know how many sheets reside in a particular stacker or other finishing device which receives the output sheets from the printer. Dorsey et al., U.S. Pat. No. 6,744,527 and Skrainar et al., U.S. Pat. No. 6,748,186, the disclosures of which are incorporated herein by this reference, disclose printers with finishing devices and user interfaces for monitoring and controlling the printer and finishing devices.

Some previously developed printers include an indicator which informs the user of the amount of sheets in a sheet feeder and/or finishing device relative to the maximum physical capacity for that sheet feeder and/or finishing device. The capacity of the finisher or stacker is typically dictated by the dimensions of the stack area. Often the capacity of the stack may permit the weight of the stack formed therein to exceed the physical capabilities of the user to manipulate the stack. Additionally, some printers allow for an adjusted or modified operational capacity which is less than a maximum physical capacity. Some finishing devices permit a user to select or set the device to run at an operational capacity less than its maximum physical capacity, for example, to accommodate a desired output stacking pattern. A user interface is often provided for monitoring of the capacity and selection of the capacity of the printer.

Some prior art indicators are limited insomuch as their measurements are indicated relative to only the maximum physical capacity of the printer, sheet feeder and/or finishing device. Such indicators provide no indication that the operational capacity is reduced from the maximum physical capacity, nor do they communicate what the reduced operational capacity is relative to the maximum physical capacity. However, this information may be desired by the user or operator of the printer, especially when a printer is operating at less than max capacity, is approaching the max capacity and is near the end of a print job. In such a situation, the user might wish to over-ride the operational limit on the capacity to allow the print job to be completed.

Users of photocopiers and similar devices that stack the output of the device would appreciate the ability to limit the size of the stack produced by the device to below the physical limits of the device. Once having limited the size of the stack produced, a user would appreciate the ability to override the stack size limit under certain circumstances. For instance, if the copy or printing job being executed is very near to completion when the stack size limit is reached, the user would appreciate the ability to override the stack limit to allow the current job to be completed in a single stack. Thus, a user of a printing device would appreciate receiving a prompt when the stack height limit is about to be reached and the option to override the stack height limit.

A user interface is provided to permit the user to set the stack limit at or below the physical capacity of the finishing device. The user interface also provides a user with the opportunity to override the stack limit as the stack limit is approach on the current job.

According to one aspect of the disclosure, a printing apparatus includes a print engine, at least one finishing module and a control module. The print engine fixes an image onto a substrate forming a hard copy. The at least one finishing module prepares and arranges a series of hard copies into sets thereof for removal by an operator. The finishing module includes a control subsystem connected to the main electronic control system. The finishing module has a physical capacity but is operable at a selectable selected limit capacity less than or equal to the physical capacity. The control module includes a main electronic control system having a user interface. The control module monitors an actual capacity in the finishing module and compares the actual capacity to an active limit capacity. The active limit capacity is either the selected limit capacity or an override limit capacity. The control module generates interactive visual information for displaying on a display of the user interface. The interactive visual information includes a limit capacity selection screen whereby an operator can select a selected limit capacity, an override screen whereby the operator can select to permit the selected limit capacity to be overridden so that the active limit capacity may be set to an override limit capacity and an override prompt screen whereby the operator can select to change the active limit capacity from the selected limit capacity to the override limit capacity.

According to another aspect of the disclosure, a method of operating a printer having a finisher module having a maximum physical sheet capacity which is operable at an operational sheet capacity equal to or less than the maximum physical sheet capacity is provided. The method comprises selecting and operational capacity, monitoring an actual level of material, comparing the monitored level and selected capacity, prompting a printer operator for override information, indicating an override selection and resetting the operational capacity if an override is indicated. The selected operational capacity is below the physical capacity of the finishing module. The actual level of material in the finishing module is monitored during operation of the printer. The monitored actual level is compared to the selected operational capacity. The printer operator is prompted to select whether the selected operational capacity should be exceeded when the monitored actual level is at or near the selected operational capacity. A response to the prompting step indicates whether the selected operational capacity should be exceeded by indicating that the selected operational capacity should be exceeded or by indicating that the selected operational capacity should not be exceeded. The operational capacity is reset to an override operational capacity above the selected operational capacity and below or equal to the physical capacity in response to an indication that the selected operational capacity should be exceeded in the indicating step.

According to yet another aspect of the disclosure, a user interface is provided for a printer having a finishing device having a maximum physical sheet capacity and being operable at an operational sheet capacity equal to or less than the maximum physical sheet capacity, a marking device which applies marks to sheets of media supplied thereto and outputs the same and a finishing device which receives the sheets from the marking device. The user interface comprises a display and an input device. The display communicates to an operator of the printer a selectable operational capacity of the finisher whereby the operator may select a selectable operational capacity, a selectable option to override the selectable operational capacity and a prompt to override the operational capacity. The input device permits the operator of the printer to indicate selections.

Additional features and advantages of the presently disclosed printer user interface and method will become apparent to those skilled in the art upon consideration of the following detailed description of embodiments exemplifying the best mode of carrying out the disclosed apparatus and method as presently perceived.

BRIEF DESCRIPTION OF THE DRAWINGS

A more complete understanding of the disclosed apparatus can be obtained by reference to the accompanying drawings wherein.

Corresponding reference characters indicate corresponding parts throughout the several views. Like reference characters tend to indicate like parts throughout the several views.

DETAILED DESCRIPTION

Figure 1:
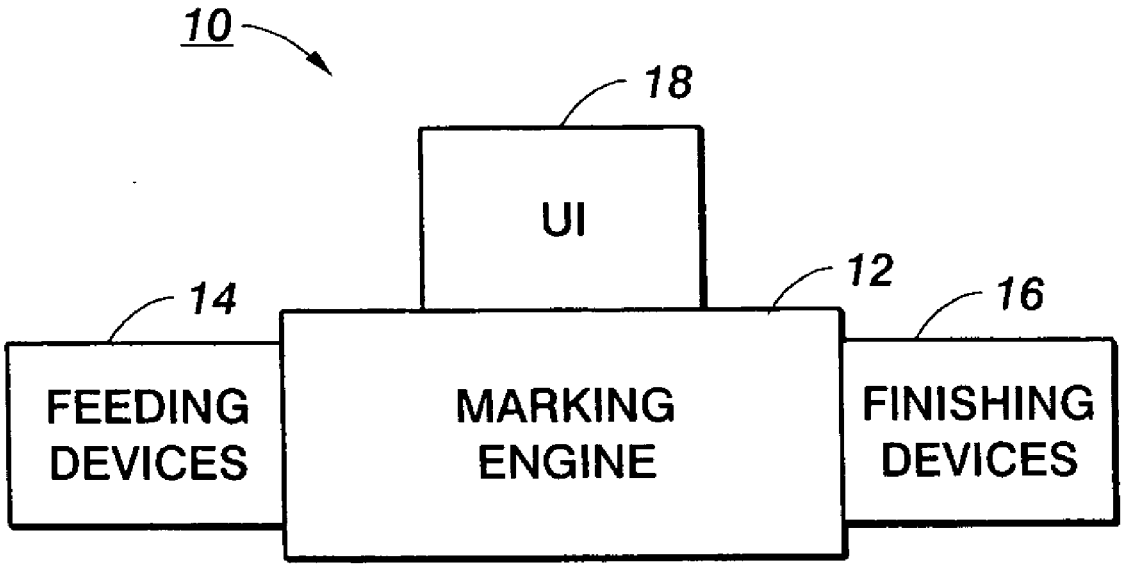
FIG. 1 is a diagrammatic illustration showing an exemplary printer in which the disclosed apparatus can be implemented and on which the disclosed method can be practiced.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

With reference to FIG. 1, a printer 10 preferably includes a print or marking engine or device 12, feeding modules or devices 14, finishers, finishing modules or devices 16, and a user interface (UI) 18. The printer 10 may be a printer, copier, facsimile machine, MFP or other like apparatus as is known in the art. In accordance with originals or data input into the printer 10, the print engine or device 12 applies ink, toner or the like to sheets of paper or other media (e.g., transparencies) supplied thereto by the feeding devices 14 which are, e.g., sheet feeders or the like. The printer 10 and/or marking device 12 may employ digital, analog, color, monochromatic, optical, laser, ink jet, xerographic, electroreproductive, electrophotographic and/or other technologies known in the art to generate appropriately marked sheets which are output to the finishing devices 16. The finishing devices 16 receive output sheets from the marking device 12 and preferably conduct one or more selected or otherwise determined finishing operations thereon, e.g., gathering, sorting, collating, stacking, stapling, binding, stitching, folding, cutting, hole punching, etc. Optionally, the feeding devices 14 may include a single or no sheet feeder. Optionally, the finishing devices 16 may include a single finisher. However, for purposes of simplicity and clarity, only the modification and override of the stack height for only one of the finishers shall be considered herein with the understanding that the description thereof is equally applicable to other finishers having a stacked output.

In one embodiment, each finisher 16 of the printer 10 has maximum physical sheet capacity (hereinafter referred to as a "physical stack height limit"). However, at times, the printer 10 may optionally work at an operational sheet capacity that is less than the physical stack height limit. An operational sheet capacity or stack limit that is less than the physical stack height limit of the finishing devices 16 can be set as desired by the user or operator, or otherwise made to, work at capacities less then their respective the physical stack height limit.

As stated, the printer 10 also preferably includes the UI 18 which allows the user or operator to control the printer 10 and/or monitor it's operation. The UI 18 is preferably a graphical UI (GUI) or other UI as is known in the art. It may be menu driven, command driven, etc. and can incorporate or utilize various folders, windows, icons, etc. The UI 18 is preferably implemented via a touch sensitive liquid crystal display (LCD), a control panel including a keypad and display device combination, and/or other suitable input/output (I/O) devices.

Figure 3:
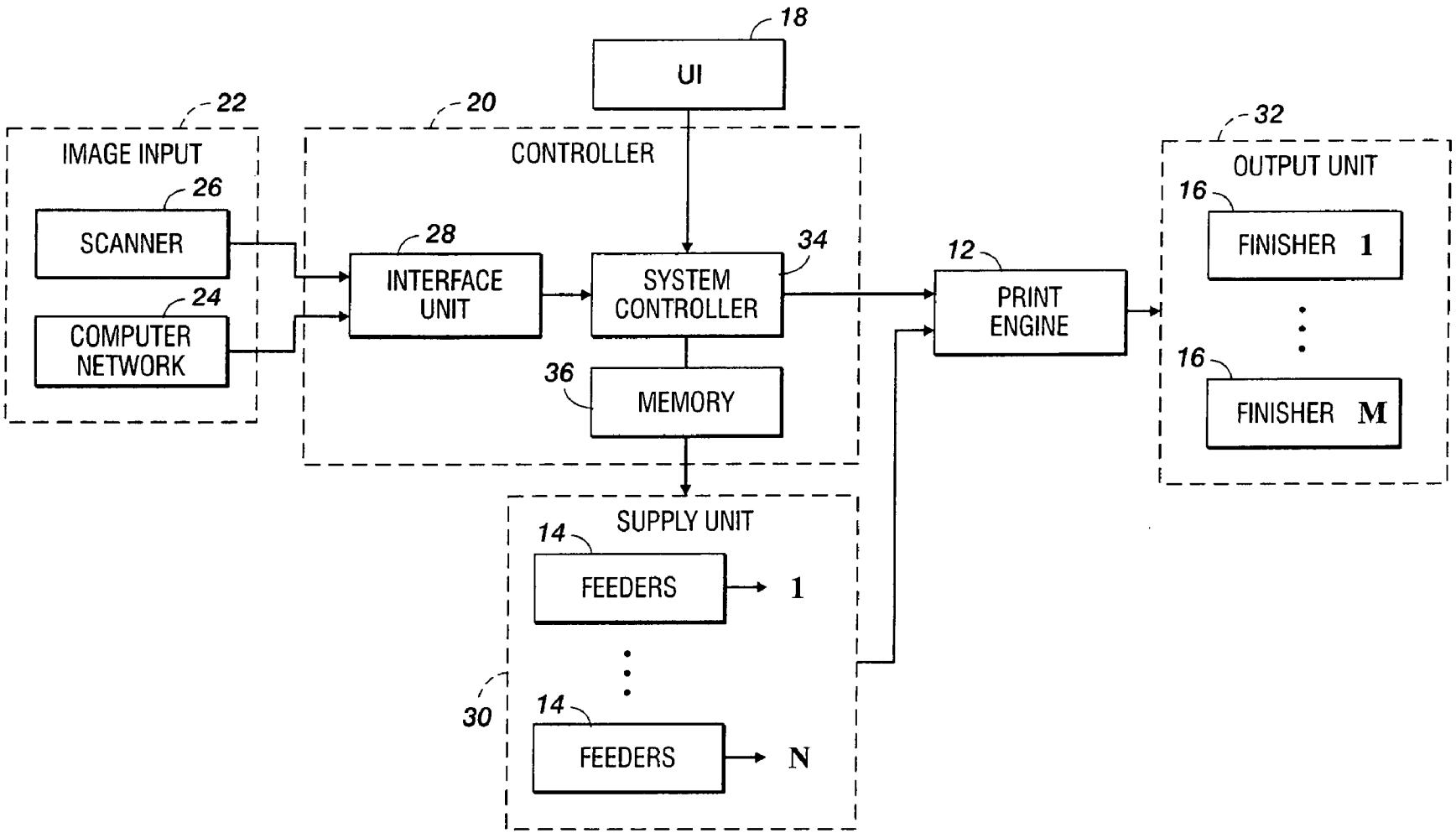
FIG. 3 is a simplified block diagram illustration of the control module of the machine of FIG. 2.

As shown in FIG. 3, an image input section 22 transmits signals to the controller 20. In the example shown, image input section 22 has both remote and on-site image inputs, enabling the printer 10 to provide network, scan and print services. In this example, the remote image input is a computer network 24, and the onsite image input is a scanner 26. However, the printer 10 can be coupled to multiple networks or scanning units, remotely or on-site.

Other systems can be envisioned such as stand alone printer with on-site image input, controller and printer. While a specific printer is shown and described, the disclosed user interface may be used with other types of printing systems such as analog printing systems.

The printer 10 can receive image data, which can include pixels, in the form of digital image signals for processing from the computer network 24 by way of a suitable communication channel, such as a telephone line, computer cable, ISDN line, etc. Typically, computer networks 24 include clients who generate jobs, wherein each job includes the image data in the form of a plurality of electronic pages and a set of processing instructions. In turn, each job is converted into a representation written in a page description language (PDL) such as PostScript.RTM containing the image data. Where the PDL of the incoming image data is different from the PDL used by the printer, a suitable conversion unit converts the incoming PDL to the PDL used by the printer. The suitable conversion unit may be located in an interface unit 28 in the controller 20. Other remote sources of image data such as a floppy disk, hard disk, storage medium, scanner, etc. may be envisioned.

For on-site image input, an operator may use the scanner 26 to scan documents, which provides digital image data including pixels to the interface unit 28. Whether digital image data is received from scanner 26 or computer network 24, the interface unit 28 processes the digital image data in the form required to carry out each programmed job. The interface unit 28 is preferably part of the printer 10. However, the computer network 24 or the scanner 26 may share the function of converting the digital image data into a form, which can be utilized by the printer 10.

As indicated previously, the printer 10 includes one or more (1 to N) feeders 14, a print engine 12, one or more (1 to M) finishers 16 and a controller 20. Each feeder 14 preferably includes one or more trays, which forward different types of support material to the print engine 12. All of the feeders 14 in the printer 10 are collectively referred to as a supply unit 30. All of the finishers 16 are collectively referred to as an output unit 32. The output unit 32 may comprise several types of finishers 16 such as inserters F, stackers G, staplers H, binders J, etc., which take the completed pages from the printer 12 and use them to provide a finished product.

The controller 20 controls and monitors the entire printer 10 and interfaces with both on-site and remote input units in the image input section 22. The controller 20 includes the interface unit 28, a system control unit 34 and a memory 36. In a broad sense, the controller 20 could be treated as including the UI 18 although UI 18 is graphically depicted as a separate component of the printer 10. The system control unit 34 receives printer information from sensors throughout the printer 10. As shown, for example, in FIGS. 5-12, the user interface 18 includes an area holding a graphic representation or picture 88 of the feeders 14, printer 12 and finishers 16 of the printer 10. The user interface 18 permits an operator to monitor the document feeders 14, printer 12 and finishers 16 by navigating through a series of menus by touching, highlighting, clicking, double-clicking, etc. on a section or otherwise opening a section of the graphical representation of the user interface 18 to reach controls or information related to that component of the printer 10. Therefore, a user (also called an operator) can associate tasks done on the user interface 18 with their physical location on the printer 10 and thereby enable faster and more intuitive navigation. The user interface 18 preferably includes a display unit 38, as shown, for example, in FIG. 12, having a display screen 40. In the illustrated embodiment, display unit 38 is a touch sensitive liquid crystal display, but may be other display devices such as a CRT, individual lights and buttons or switches, etc. for allowing a user to interact with the printer 10.

Figure 4:
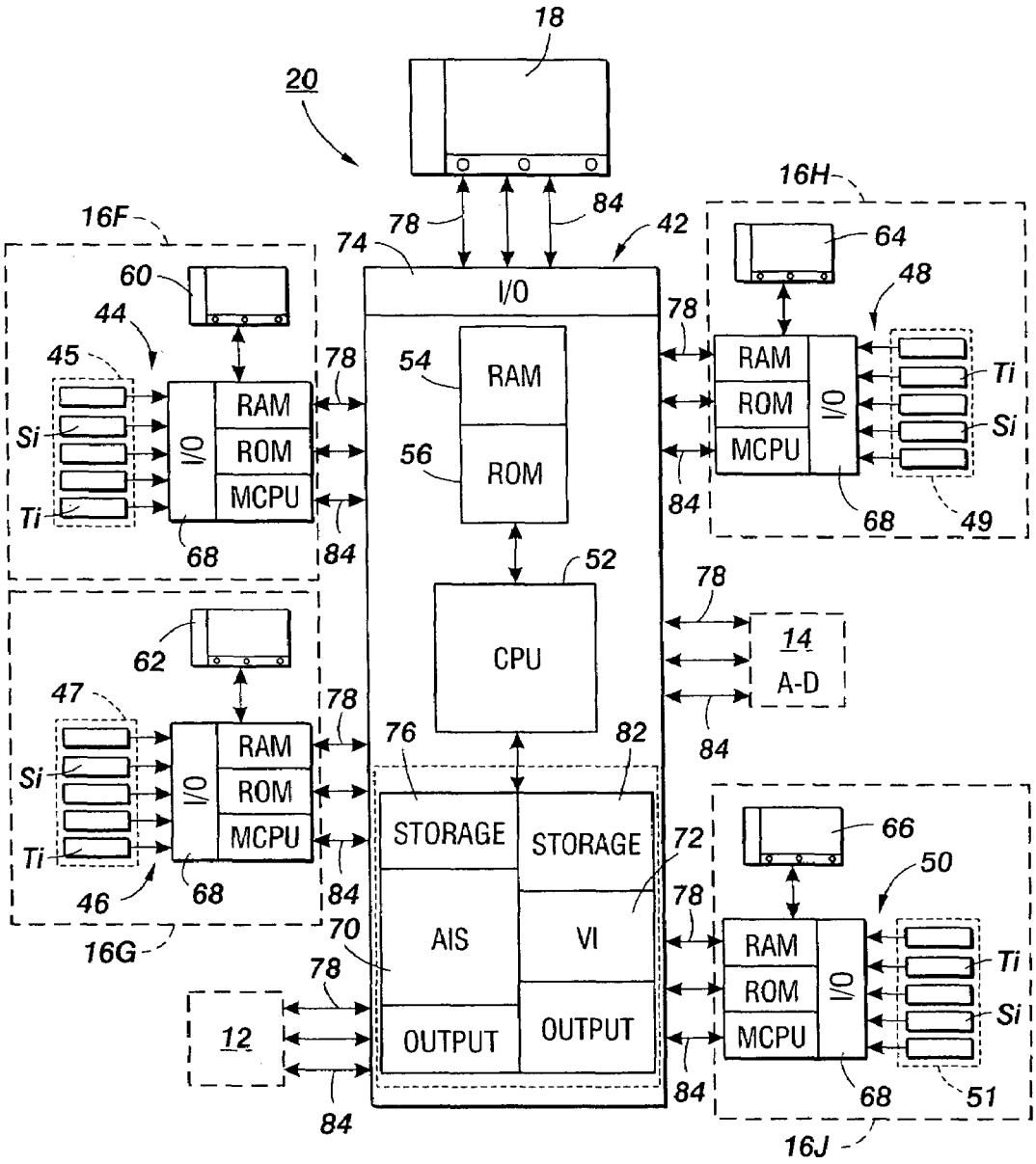
FIG. 4 is a more detailed block diagram illustration of the control module of FIG. 3.

As shown, for example, in FIG. 4, the printer 10 includes a controller 20 including an electronic control subsystem (ESS) 42, the UI 18 and distributed module-specific control subsystems 44, 46, 48, 50. The distributed module-specific control subsystems 44, 46, 48, 50 are suitable for providing information regarding the status of and controlling the operation of the remote modules. In FIG. 4, because the disclosure focuses on controlling the operation and functioning of the finishers 16 of a printer 10, only the control subsystems 44, 46, 48, 50 for the finisher modules 16 F-J are specifically shown while the distributed modules of the feeders 14 and the modules in the print engine 12 are shown graphically as a box. Those skilled in the art will recognize that each feeder 16 A-D and the modules in the marking device 12 could, and typically would, include control subsystems within the scope of the disclosure.

Each of the control units such as 42, 44, 46, 48, 50 can be a self-contained, dedicated minicomputer or programmable microprocessor which can be programmed to provide various controls including, for example, a comparison count of the copy sheets, the number of documents being re-circulated, the number of copy sheets selected by the operator, time delays. In particular they can be programmed in accordance with the disclosure to provide user selection of stack limits below the physical stack height limit of a finisher 16 and override of the selected stack limits.

Thus, the illustrated control module 20 includes (for example in the ESS 42), a self-contained, dedicated minicomputer having a central processor unit (CPU) 52, memory devices 54, 56 (collectively referred to above along with storage 76, 82 as memory 36), and a main centrally located display or UI 18. The control module 20 (including the ESS 42), with the help of sensors Si, switches Ti and connections, can read, capture, prepare and process image data as well as machine status and module-specific fault information.

Figure 2:
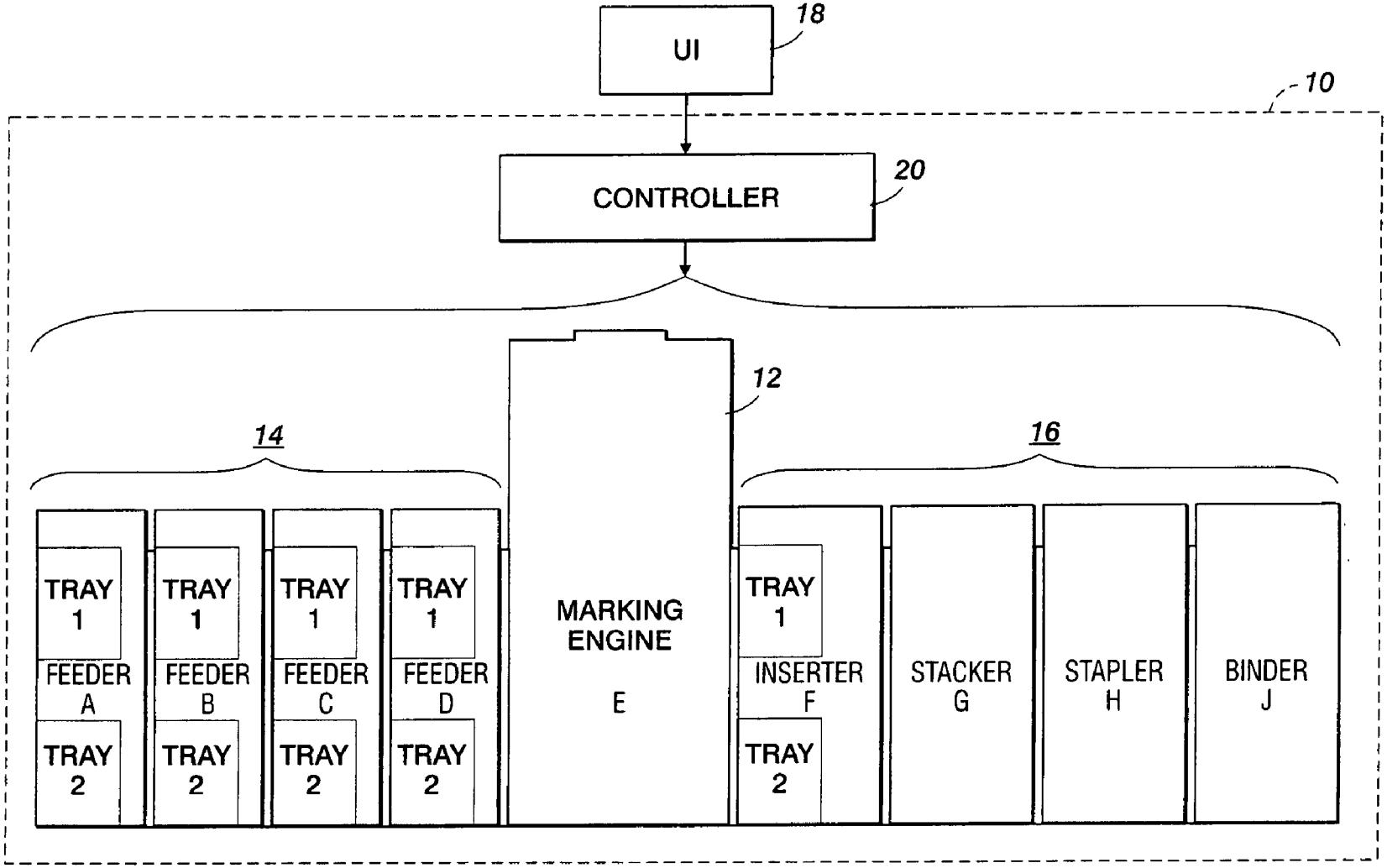
FIG. 2 is a general block diagram of the printing system shown in FIG. 1.

Referring in particular to FIGS. 1 and 2, the printer 10 for example has sheet feeding modules 14 A-D that are redundant, a print engine 12 that may include a development module, photoreceptor module, fusing module, and hard copy finishing modules. The printer 10 of course also includes the control module 20 that itself includes the distributed module user interface devices 60, 62, 64, 66 for providing information regarding the dedicated modules.

Referring in particular to FIG. 4, a block diagram of the control module 20 of the printer 10 is illustrated, and includes the distributed module-specific control subsystems 44, 46, 48, 50, etc. As illustrated, in addition to the distributed module-specific control subsystems 44, 46, 48, 50, etc., the control module 20 includes the main electronic control system ESS 42 having the centrally located user interface 18.

As further shown, each of the distributed module-specific control subsystems 44, 46, 48, 50, etc. is associated with a dedicated module 16F-J, 14A-D and/or a module of print engine 12, and is suitable for providing monitoring and or control of the operation for each such the dedicated module. Each of the distributed module-specific control subsystems 44, 46, 48, 50, etc is connected to the electronic control system 42 and to sensors and actuators 45, 47, 49, 51 of the dedicated module. As shown, each the module-specific control subsystems 44, 46, 48, 50, etc., has a module user interface device 60, 62, 64, 66 located at the dedicated module. Location of the module user interface devices 60, 62, 64, 66 as such is suitable for enabling recovery-while-running isolation for redundant dedicated modules 50, 51 and 260, 262, for example.

Still referring to FIG. 4, in anyone of the finisher modules 16F-J, the sensors and actuators 45, 47, 49, 51 may comprise a paper jam detector Ti, out of registration detector, level violation sensor Si, stacker tray jam detector, as are well other known sensors and actuators. In other modules, the sensors and actuators (Ti and Si) may include appropriately a paper-out detector, a toner insufficiency detector, a document left-out detector, a reset button no-depression detector, a no key counter detector, a top cover "open" detector etc.

In each dedicated module 16F-J, 14A-D and/or a module of print engine 12, the sensors and actuators 45, 47, 49, 51 are connected to the main electronic control system 42 through an input/output interface section 68. The central processing unit or CPU 52 is programmable for controlling the overall operation of all modules and other operating components of the printer 10. The ROM section 56 stores sequence programs for the machine operations including some control programs for the audio information synthesizing (AIS) section 70 and for the visual information processing section 72.

The random access memory RAM section 54 stores data required in the CPU 52, and an input/output I/O control section 74 for controlling the input and output of signals or data from the sensors and actuators 45, 47, 49, 51.

The AIS section 70 for example comprises an auditory information data storage section 76, and a synthesizer control section (not shown) which itself may be a microprocessor. In operation, in response to a status input by the sensors and actuators 45, 47, 49, 51, the AIS section 70 reads out corresponding audio information from the information storage section 76 and then synthesizes the read information on the basis of pre-programmed instructions that are part of the main electronic control system 42 or of the module-specific control subsystem 44, 46, 48, 50. The audio information synthesized thus is then converted to voice form, and transmitted via audio means 78 to the audio output section or speaker (not shown) of the module user interface devices 60, 62, 64, 66 and the user interface 18.

Similarly, in response to inputs by the sensors and actuators 45, 47, 49, 51, the visual information section 72 reads out corresponding visual information from a visual information storage section 82 on the basis of pre-programmed instructions that are part of the main electronic control system 42 or of the module-specific control subsystem 44, 46, 48, 50. The visual information read thus is then displayed or transmitted via means 84 to a visual output section of the module user interface devices 60, 62, 64, 66 and the UI 18.

Figure 5:
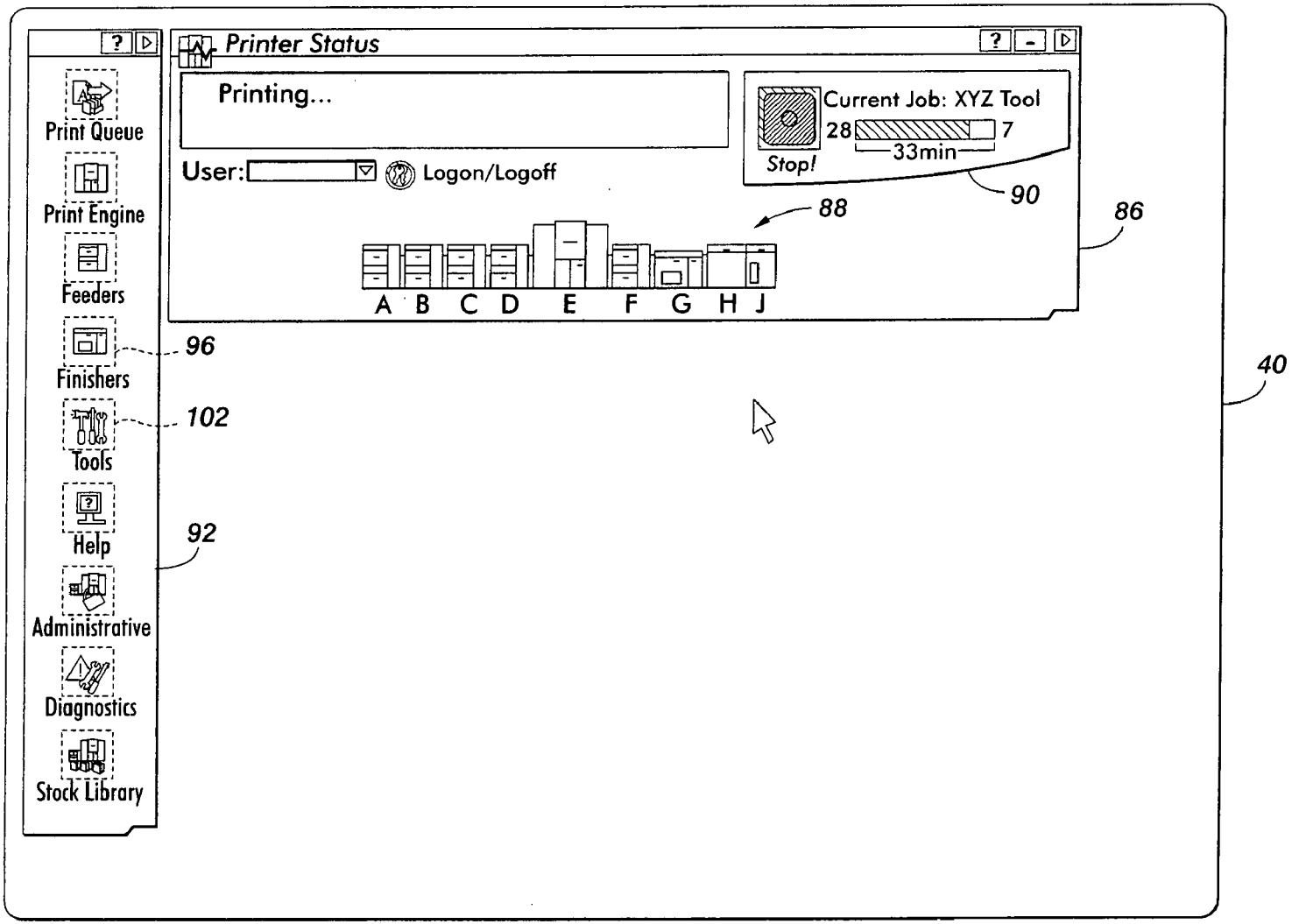
FIG. 5 is a view depicting an exemplary graphical representation of printer status window and pathway access window displayed on a user interface screen of the printing system shown in FIGS. 1 and 2.

FIGS. 5-12 show a series of menus and graphical representations displayed on a display screen 40, which are used to reach controls or information related to components or supplies in the printer 10. FIG. 5 shows a printer status window 86 having a printer icon 88 including feeder icons A-D, printer icon E, and finisher icons F-J. However, as indicated above, feeder icons and finisher icons can be added or removed so that the printer icon 88 is an accurate depiction of the printer 10 actually being used by the operator. The printer status window 86 also includes a job progress meter 90, which continuously informs the operator of the total time required to complete a print job (e.g. 33 minutes), the time that has elapsed since the print job began (e.g. 28 minutes) and the time remaining (7 minutes). This enables the operator to make choices as to whether to stop or suspend the current job in order to process a higher priority job and whether to override a stack limit. FIG. 5 also shows a pathway access window 92, which also provides access to information and control of the printer 10.

Figure 6:
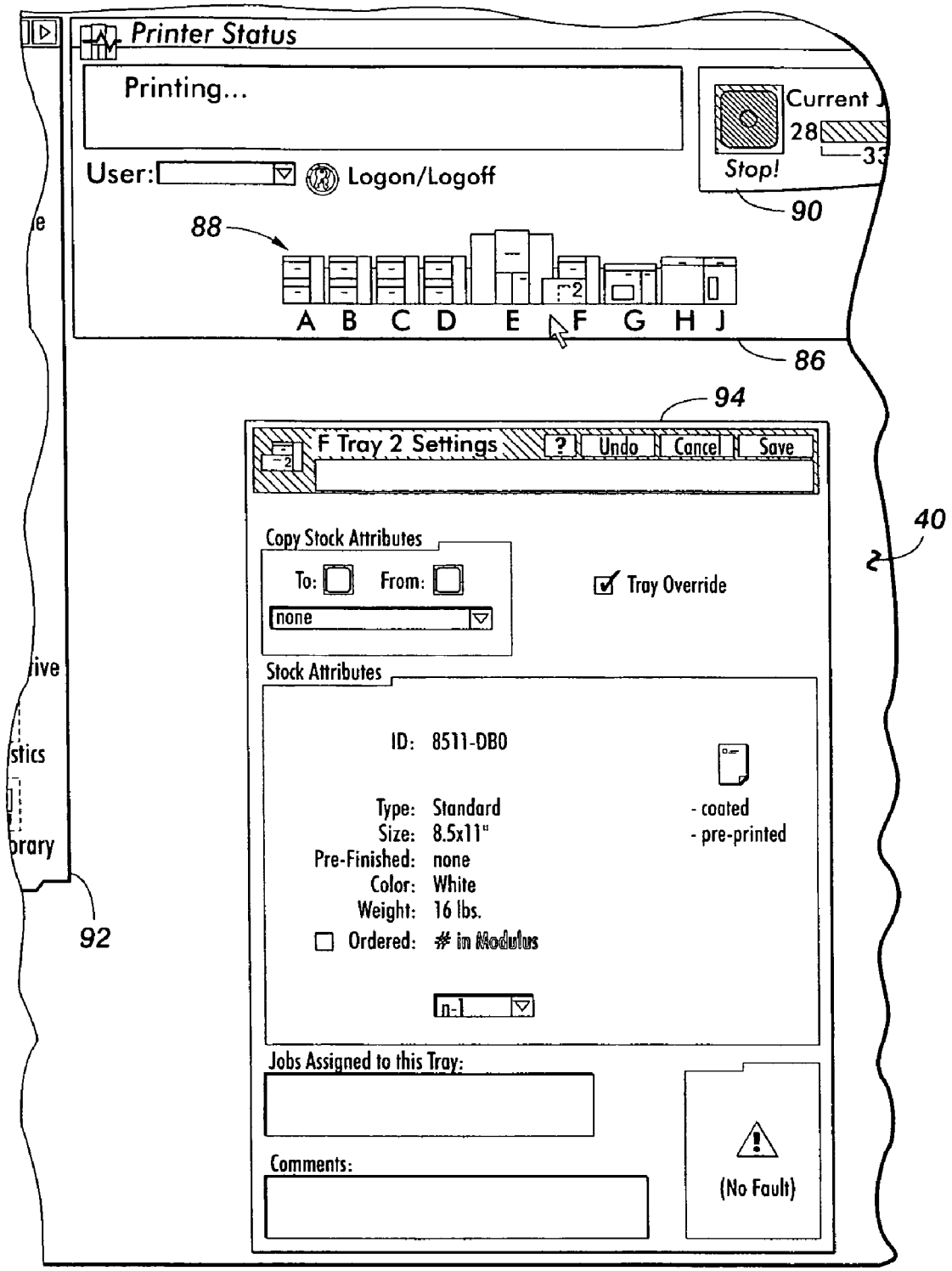
FIG. 6 is a view depicting an exemplary graphical representation of finisher tray information of an inserter displayed on a user interface screen of the printing system shown in FIGS. 1 and 2.
Figure 8:
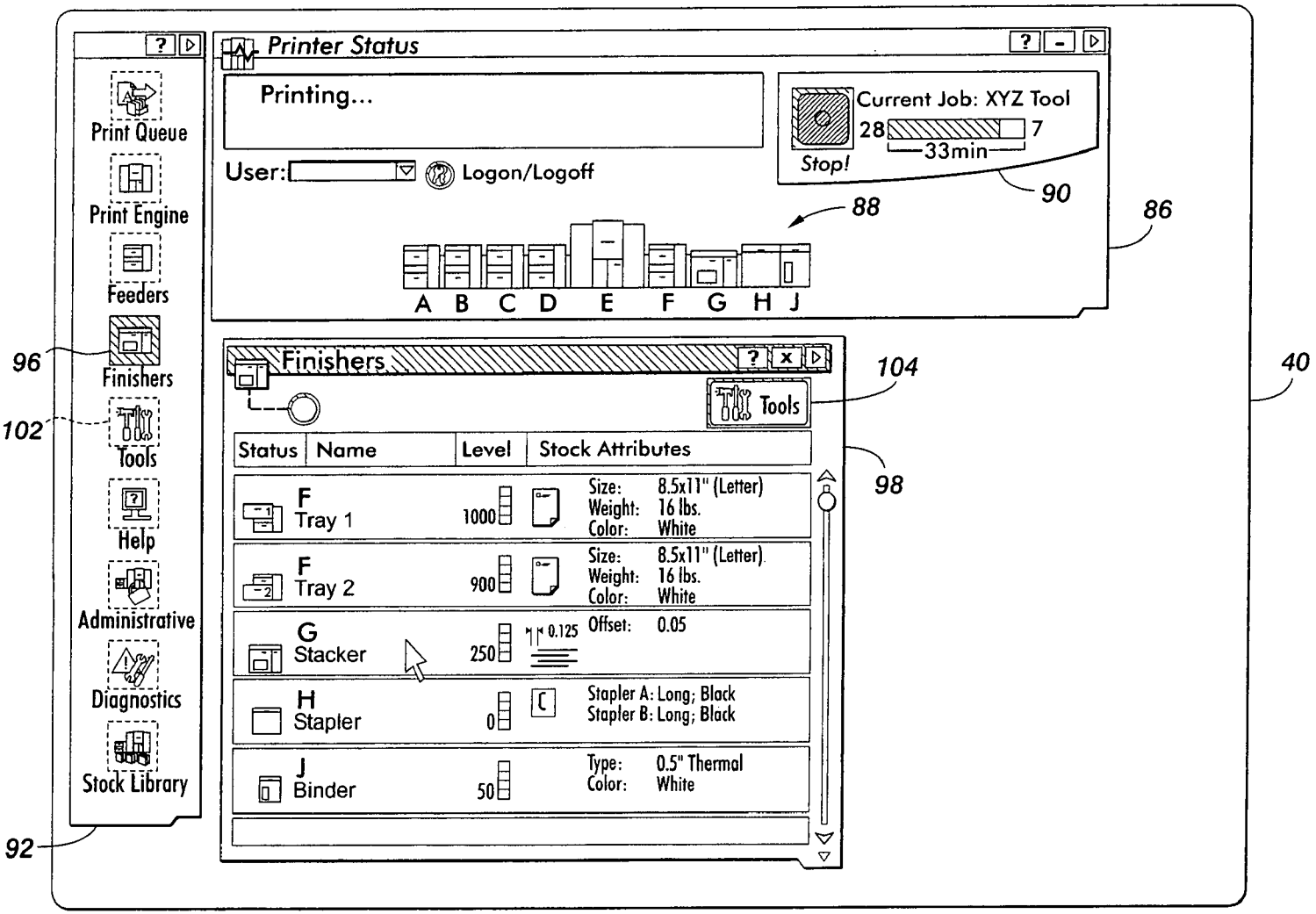
FIG. 8 is a view depicting an exemplary graphical representation of finisher information displayed on a user interface screen of the printing system shown in FIGS. 1 and 2.

An operator can monitor finishers 16 by selecting a finisher icon in printer icon 88, for example a tray 2 of inserter 16F as shown in FIG. 6, or by alternatively selecting the finishers button 96 in the pathway access window 92 and selecting the desired finisher 16 from the finisher menu screen 98 (FIG. 8). FIG. 6 shows a display of inserter 16F tray 2 information screen 94 which provides the attributes of the support material or stock currently in tray 2 of inserter 16F. An inserter inserts preprinted material as needed to complete a job. The operator can change the type of stock contained in the tray from here and also turn the tray override setting on or off.

Figure 7:
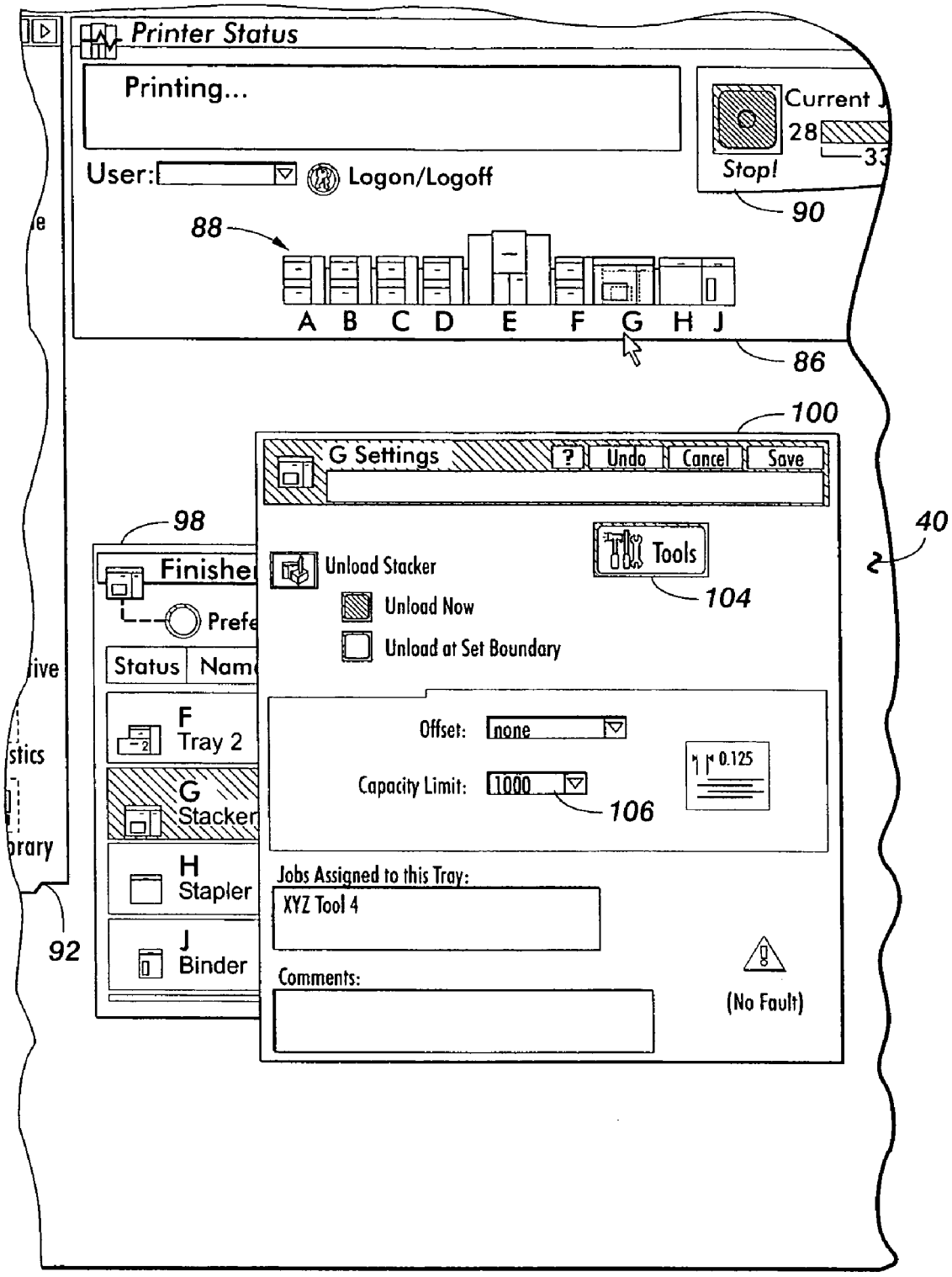
FIG. 7 is a view depicting an exemplary graphical representation of stacker information displayed on a user interface screen of the printing system shown in FIGS. 1 and 2.

By selecting stacker G icon in the printer icon 88, or by alternatively selecting the finishers button 96 in the pathway access window 92 and selecting the stacker G icon from the finisher menu screen 98, a stacker information screen 100, is displayed on the display screen 40, as shown, for example, in FIG. 7. The operator can change some settings within these windows. In the stacker information screen 100, the operator can use the unload button and adjust offset and capacity limit settings.

Similar stapler information screens and binder information screens can be accessed in a similar manner. In the settings window for the stapler and binder (H and I) information screens, settings may be entered for the staple color and type. Further, folding, trimming, and rotation options may be offered and be turned on or off.

A brief summary of the finisher information of each finisher 16 is displayed on a finisher information screen or menu 98 by clicking on the finishers icon/button 96 in the pathway access window 92 as shown in FIG. 8.

Figure 9:
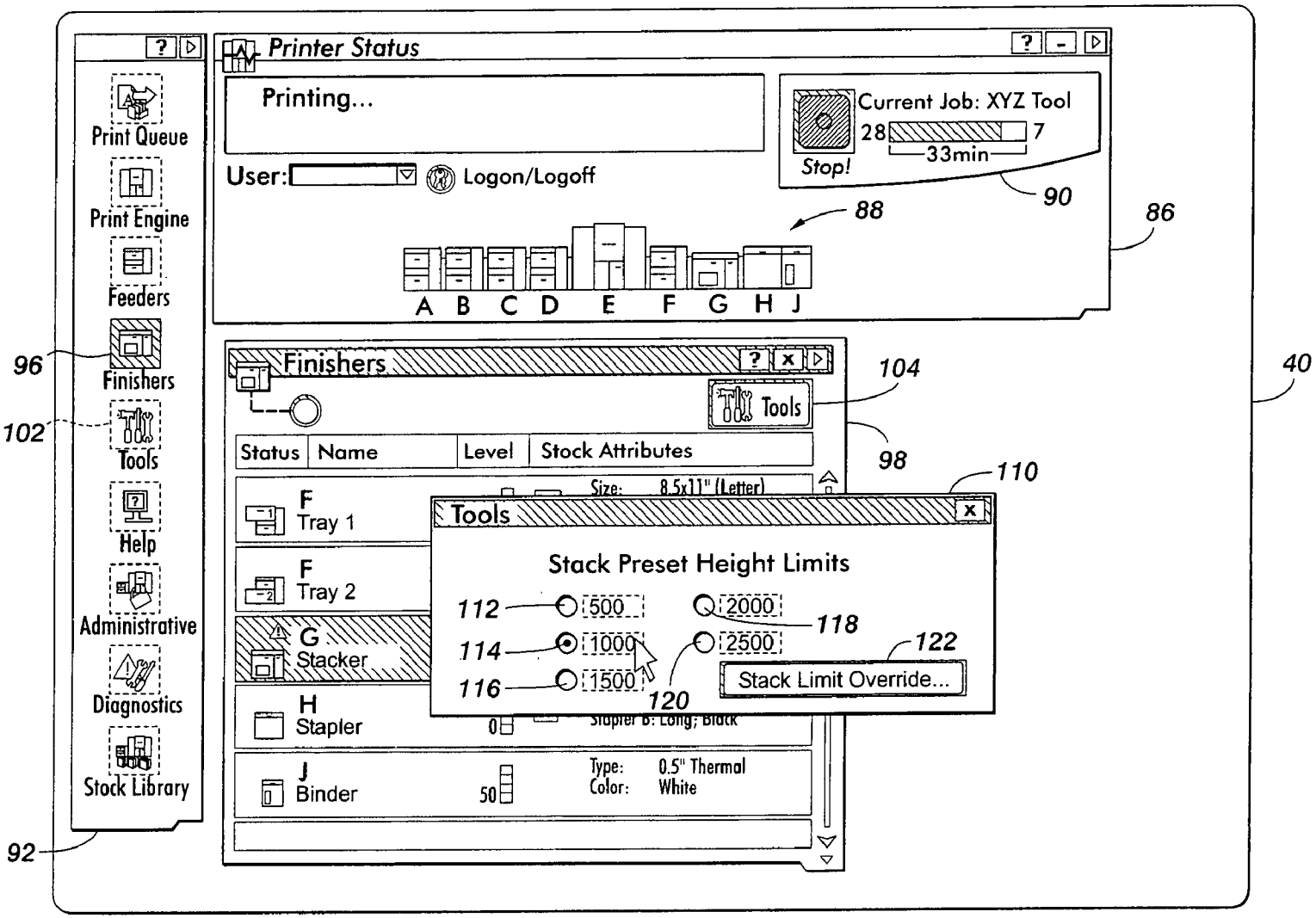
FIG. 9 is a view depicting an exemplary graphical representation of tools relating to a finisher displayed on a user interface screen of the printing system shown in FIGS. 1 and 2.

By actuating the tools button 102 in the top level screen (FIG. 5) and selecting the stacker G from a menu screen, or by actuating the tools button 104 in the stacker information screen 100, the UI 18 is caused to display a stack preset height limits screen 110, as shown, for example, in FIG. 9. The illustrated screen 110 includes radio buttons 112, 114, 116, 118, 120 for selecting predetermined stack limits at or below the physical stack height limit of the stacker 16G. A stack limit override button 122 is also displayed on the stack preset height limits screen 110.

Illustratively, the stack preset height limits screen 110 provides a button 112 for selecting a stack limit of 500, a button 114 for selecting a stack limit of 1000, a button 116 for selecting a stack limit of 1500, a button 118 for selecting a stack limit of 2000 and a button 120 for selecting a stack limit of 2500. Similar selections of stack limits are accessible from the capacity limit drop down list 106 provided in the stacker information screen 100. It is within the scope of the disclosure for the user to be able to select any stack limit at or below the physical stack height limit and not be restricted to predetermined stack limits. For purposes of this disclosure, it is assumed that stacker 16 G has a physical stack height limit of 2500. For instance, a user may select the text box in the Capacity Limit drop down list 106 of the stacker information screen 100 and enter a stack limit at or below the physical stack height limit, i.e. from 0-2500.

Figure 10:
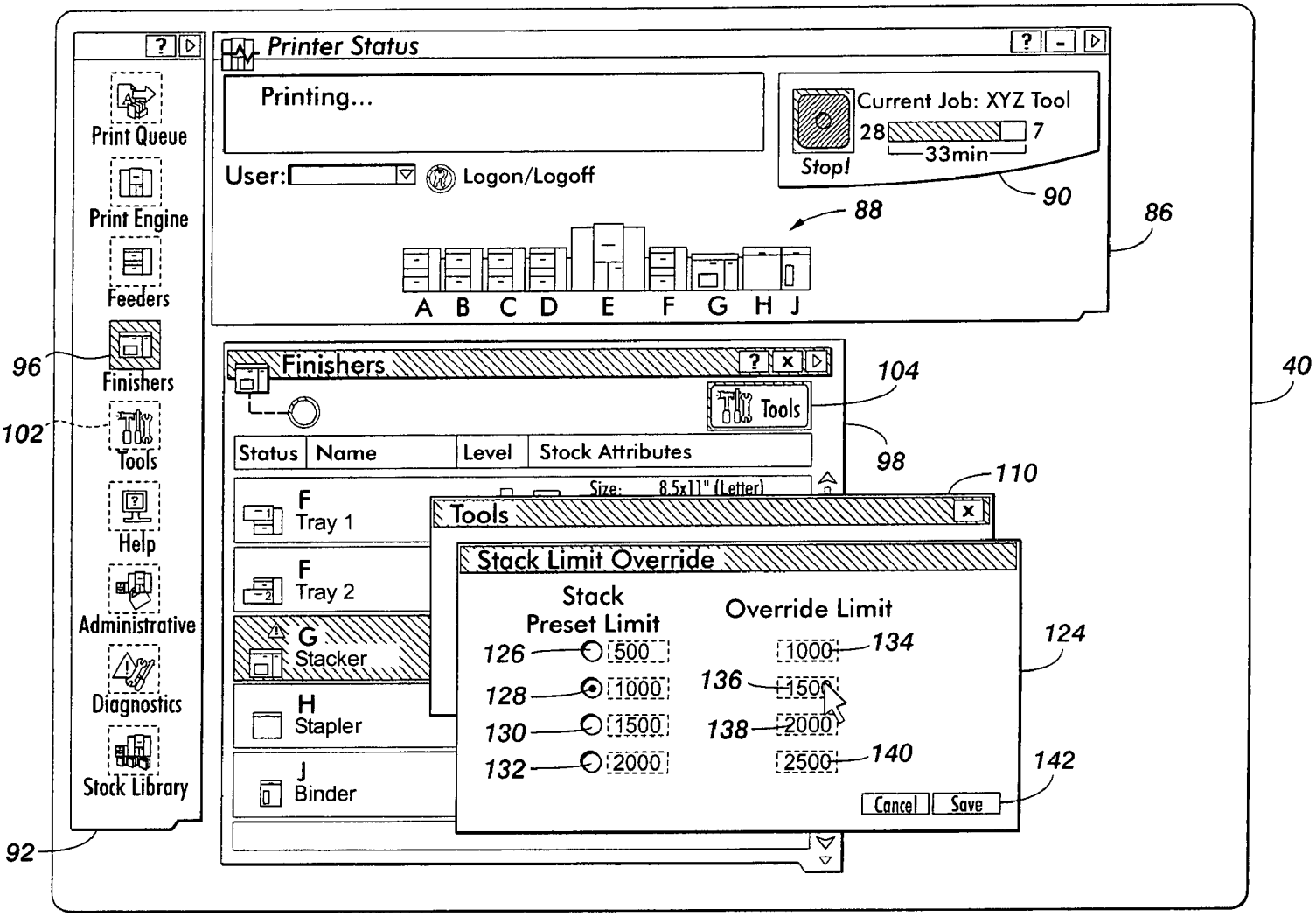
FIG. 10 is a view depicting an exemplary graphical representation of a stack limit override screen accessible from the tools screen relating to a finisher displayed on a user interface screen of the printing system shown in FIGS. 1 and 2.

Upon selection of the stack limit override button 122, the UI 18 displays a stack limit override screen 124 as shown, for example, in FIG. 10. The stack limit override screen 124 includes a column of radio buttons 126, 128, 130, 140 to indicate the current stack limit that the user wishes to permit to be overridden. Illustratively, the stack limit override screen 124 provides a button 126 for selecting a stack preset limit of 500, a button 126 for selecting a stack preset limit of 1000, a button 128 for selecting a stack preset limit of 1500 and a button 130 for selecting a stack preset limit of 2000. Since it is assumed that the physical stack height limit of the stacker 16G is 2500, a button for selecting a preset stack limit of 2500 is not provided on the stack limit override screen 124 because such limit cannot be physically overridden.

The stack limit override screen 124 also includes a column of override icons 134, 136, 138, 140 which may be active or inactive. In the illustrated embodiment, the stack limit override screen 124 includes an override icon 134 to allow the stack limit to be overridden to 1000, an override icon 136 to allow the stack limit to be overridden to 1500, an override icon 138 to allow the stack limit to be overridden to 2000 and an override icon 140 to allow the stack limit to be overridden to 2500. There is no need for an override icon to allow the stack limit to be overridden to 500 in the illustrated example since 500 is the smallest illustrated stack limit. Also, there is no need for an override icon to allow the stack limit to be overridden to above 2500 since that is the physical stack height limit of the illustrated device.

In the illustrated embodiment, the override icons 134, 136, 138, 140 are active meaning that selection of an override icon is permitted. Illustratively, upon entering the stack limit override screen 124, the radio button 126, 128, 130, 132 associated with the stack limit selected on the stack preset height limits screen 110 is highlighted. It is assumed that a stack limit of 1000 was selected in the stack preset height limits screen 110 so the radio button 128 for a stack preset limit of 1000 is highlighted in FIG. 10. Also, the default override value for the selected stack limit is highlighted upon entry into the stack limit override screen 124. In the illustrated embodiment, the default override value for each stack preset limit is the value of the next higher stack preset limit. Thus, in FIG. 10, since it is assumed that a stack limit of 1000 was selected, the override icon 136 for an override limit of 1500 is highlighted upon entry into the stack limit override screen 124.

After entering the stack limit override screen 124 the user is permitted to select any of the radio buttons 126, 128, 130, 132 to change the value of the selected stack limit if so desired. Upon selecting a stack limit radio button 126, 128, 130, 132, the override icon 134, 136, 138, 140 associated with the next higher limit is highlighted, all override icons for stack limits lower and equal to the selected radio button are disabled and all override icons associated with higher stack limits are enabled. Thus, when the radio button 128 for the stack preset limit of 1000 is selected or otherwise highlighted, the override icon 134 for an override limit of 1000 is deactivated, the override icons 136, 138, 140 for override values of 1500, 2000, 2500, respectively, are enabled and the override icon 136 for an override value of 1500 is initially highlighted since it is the default override value for the selected stack limit. When other radio buttons 126, 130, 132 are selected, the override icons 134, 136, 138, 140 are enabled, disabled and initially highlighted in an appropriate manner based on the restrictions described above.

In the illustrated embodiment, once the appropriate radio button 126, 128, 130, 132 corresponding to the desired stack limit is highlighted, the user may elect to select the default override value by selecting the save button 142 or may to select to set the override limit at some higher value than the default value by selecting the override icon 136, 138, 140 for a higher override limit. Any effort to select an override limit lower than or equal to the highlighted stack preset limit may result in an error message or signal being generated indicating that the selected override limit is not active for the highlighted stack preset limit. When an override limit higher than the default value is selected, the override icon 1136, 138, 140 for that value is highlighted. Selecting the save button 142 causes the currently highlighted stack preset limit value and override limit value to be stored in memory 36 where it is available to be utilized by the controller 20 in monitoring operation of the printer 10.

Figure 11:
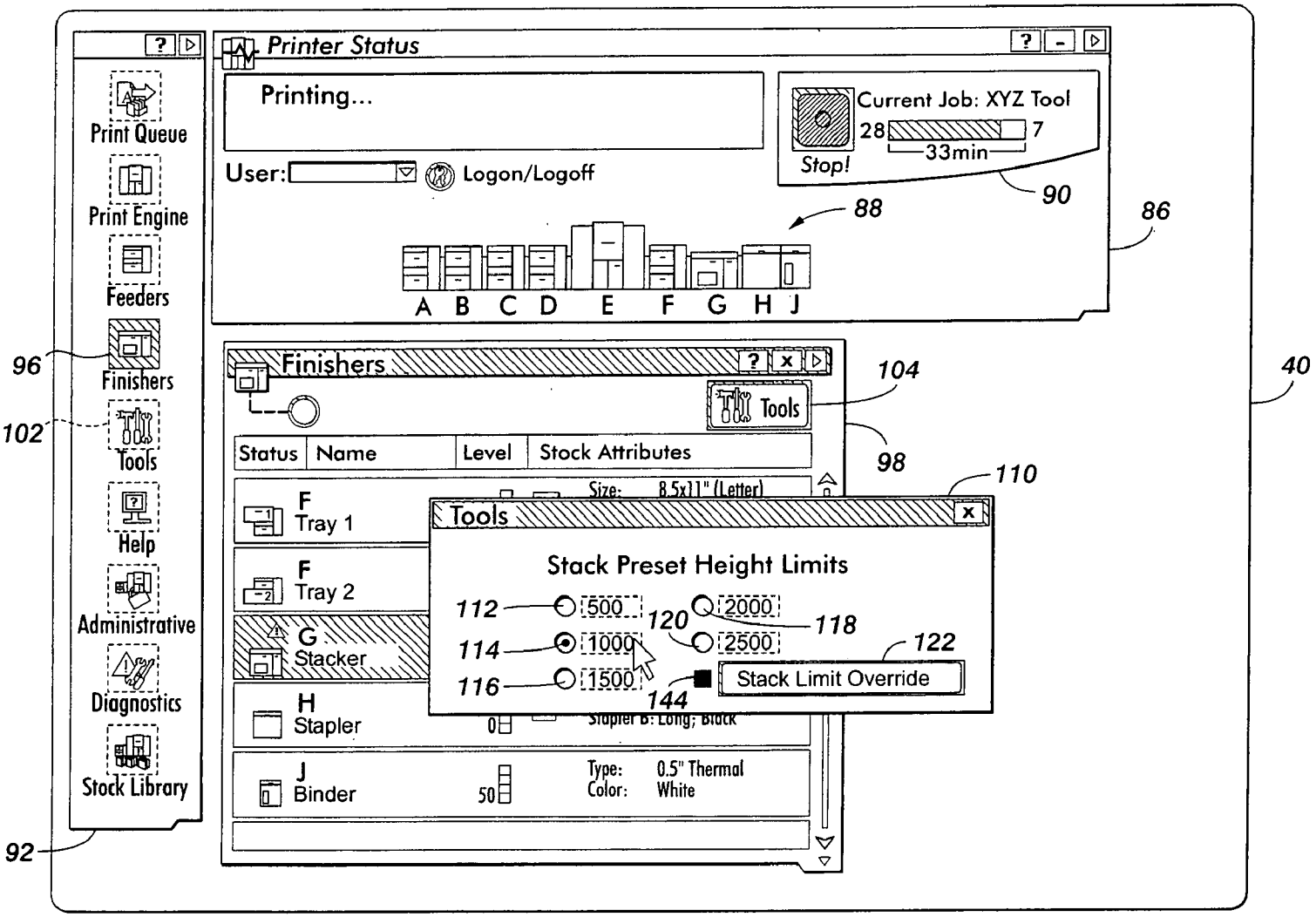
FIG. 11 is a view depicting an exemplary graphical representation the tools screen relating to a finisher displayed on a user interface screen of the printing system shown in FIGS. 1 and 2 indicating that the stack preset height limit has been set and that the stack limit override has been implemented.
Figure 12:
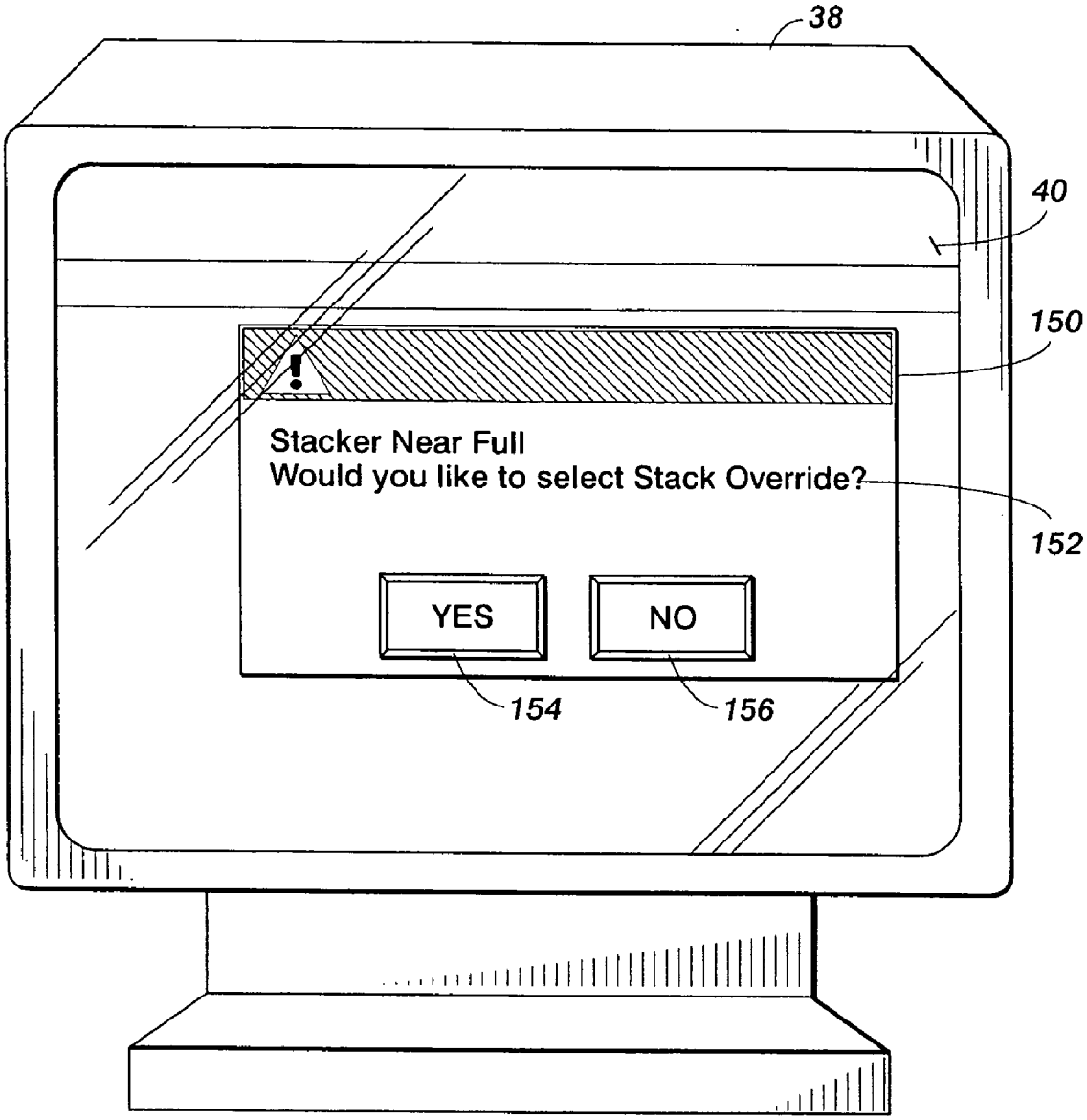
FIG. 12 is a view depicting an exemplary graphical representation of a prompt screen accessible displayed on a user interface screen of the printing system shown in FIGS. 1 and 2 to permit the user to select whether the stack limit should be overridden; and, FIG. 13 is a flow chart showing the process of implementing the stack limit modification and stack limit override.

Selecting the save button 142 in the stack limit override screen 124, causes the UI 18 to return to displaying the stack preset height limits screen 110, as shown, for example, in FIG. 11. When an override limit value has been selected by the user an indicator 144 adjacent the stack limit override button 122 is highlighted. Also, the radio button 112, 114, 116, 118, 120 for the currently selected stack limit is highlighted.

Those skilled in the art will recognize that other methods and devices might be utilized to select a stack limit for each finisher and a stack limit override value. For instance, the user may be enabled to enter any value for the stack limit up to the physical stack height limit of the device and may be permitted to enter any higher value for the stack limit override value up to the physical stack height limit within the scope of this disclosure. Alternatively, the radio buttons 126, 128, 130, 132 for the stack preset limits in the stack limit override screen 124 may not be active so that upon entry into the stack limit override screen 124 the user is limited to accepting or rejecting a default override limit for the stack limit selected in the stack preset height limits screen 110 or to selecting an override limit above the pre-selected stack limit. Other means of selecting a stack limit and an override value for a finisher are within the scope of the disclosure, including but not limited to, actuating switches on the finishers to set a stack limit and actuating switches to override the stack limit.

Illustratively, the job progress meter 90 displayed on the UI 18 provides a visual representation of the sheet level and/or number of sheets contained in or received by the finishing device 16. The job progress meter 90 also communicates to the user or operator the physical stack height limit and the current stack limit for the finisher 16. The job progress meter 90 is preferably displayed by or visualized on the UI 18 and is preferably implemented via software running on an interface platform or controller 20 that controls and/or monitors operation of the printer 10. Alternately, the job progress meter 90 is implemented via hardware or a combination of both software and hardware.

The controller 20 monitors the progression of a print job and sheet level and/or number of sheets in the finisher 16. As the sheet level/or number of sheets in the finisher approaches the stack limit, if the user has selected the stack limit override option, the controller 20 generates an override prompt screen 150 that is displayed on the display screen 40 of the UI 18, as shown, for example, in FIG. 12. Illustratively, the override prompt screen 150 provides a text message 152 indicating that the stack limit is being approached and an option to override the stack limit by pressing the yes button 154 or to not override the stack limit by pressing the no button 156. If the user selects to override the stack limit by selecting the yes button 154, the controller 20 access the override limit stored in memory 36 and allows the print job to continue past the stack limit until the job is completed or the override limit is reached. If the user selects to not override the stack limit by selecting the no button 156, the controller 20 allows the print job to continue until the stack limit is reached or the job is completed, whichever occurs first. The controller 20 may be programmed to temporarily terminate the print job when the stack limit is reached if it has received no response to the override prompt prior to the stack limit being reached. The controller 20 generate other visual and/or audible prompts and warnings when the stack limit is about to be reached or has been reached within the scope of the disclosure.

Figure 13:
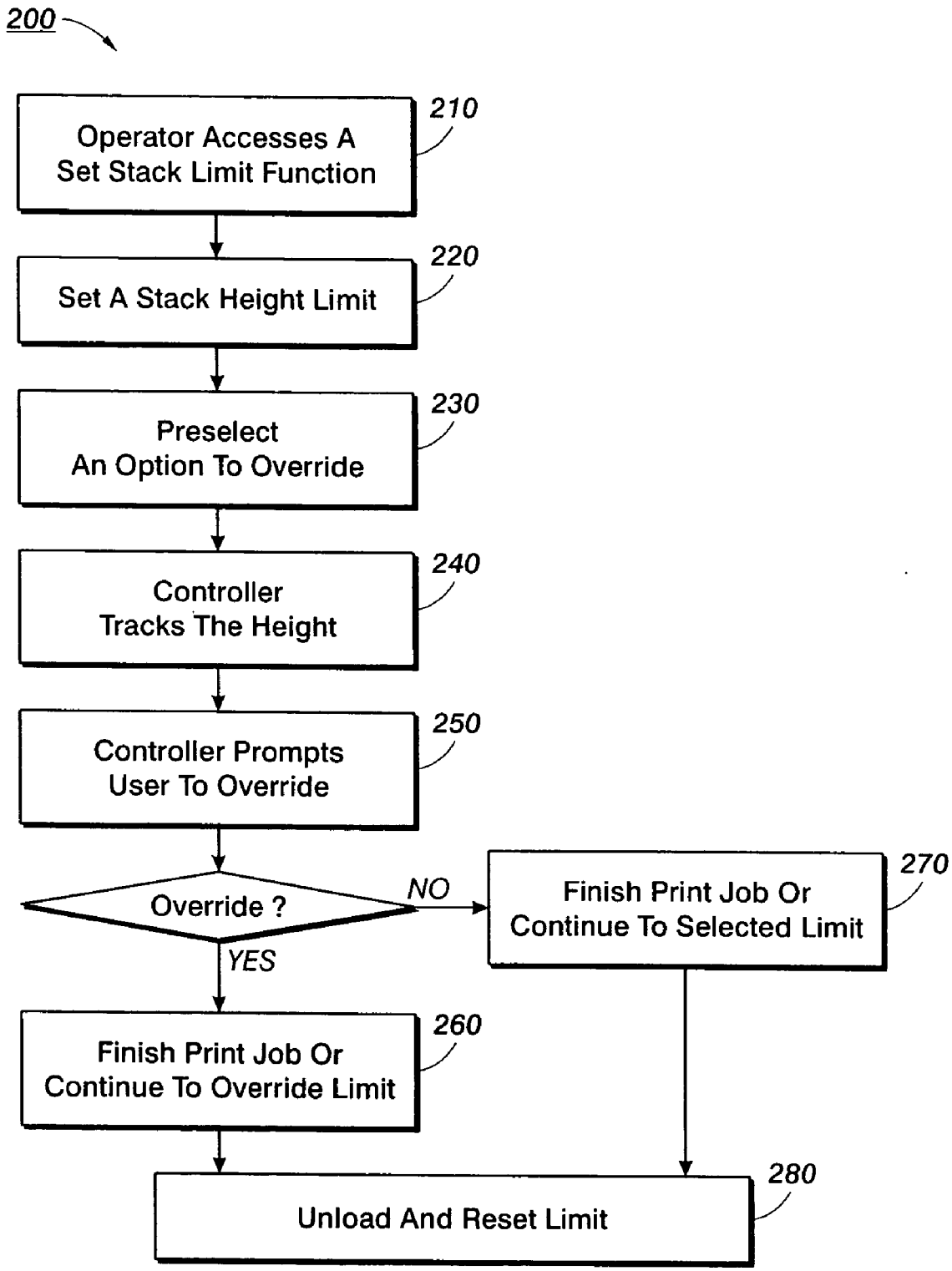

FIG. 13 shows one example of setting a stack limit and a stack limit override in a printer having a finisher that is capable of being provided with a stack limit that is less than or equal to its physical stack height limit. An operator accesses a set stack limit function in step 210. In the illustrated device 10 wherein a stack limit is being set for the stacker 16G, the step 210 is accomplished by selecting either the icon for the stacker 16G in the printer icon 88 on the upper level screen of the UI 18 and then selecting the tool button 104 in the stacker information screen 100 or by selecting the tools button 102 on the pathway access window 92 and the appropriate finisher icon from a menu screen or selecting the capacity limit button 106 in the stacker information screen 100.

The user sets a stack height limit in step 220. In the illustrated printer 10, the setting the stack height limit step 220 is performed by selecting the desired radio button 112, 114, 116, 118, 120 in the stack preset height limits screen 110. Alternatively, the stack height limit may be set in the stack limit override screen 124 by the user selecting the radio button 126, 128, 130, 132 corresponding to the desired stack preset limit. As described above, alternative methods of setting the stack height limit are within the scope of the disclosure.

The user determines whether to preselect an option to override the stack height limit in step 230. In the illustrated printer, the preselection of the option to override the stack limit step 230 is performed by selecting the stack limit override button 122 on the stack preset height limits screen 110, ensuring that an override limit icon 134, 136, 138, 140 is highlighted in the stack limit override screen 124 and selecting the save button 142.

The controller tracks the height of the stack in the stacker during a print job operation in step 240.

When the controller determines that the height of the stack in the stacker is approaching the preset stack limit, the controller prompts the user to override the preset stack limit in step 250. In the illustrated printer 10, the controller 20 compares the selected stack height limit stored in memory 36 to the tracked height of the stack in the stacker 16G. When the difference between the two values approach zero, the controller 20 generates an interactive prompt screen 150 indicating that the stacker is near full and providing options to either override or not override the stack limit by providing interactive button 154, 156 on the prompt screen 150.

If the user overrides the stack limit, the controller permits the printer to continue the print job until either the print job is completed or the stack height in the finisher equals the override stack limit whichever occurs first in step 260. In the illustrated printer 10, the user overrides the stack limit by selecting the yes button 154 on the prompt screen 150. Selecting override causes controller to compare the actual stack height to the override value stored in memory 36. The controller 20 then permits the print job to continue while comparing the actual stack height to the override value. If the actual stack height becomes equal to the override value, the controller temporarily stops the current print job to allow the stacker to be unloaded. Otherwise, the print job is continued until completed.

If the user elects not to override the stack limit, the controller permits the printer to continue the print job until the stack height in the finisher equals the stack limit or the print job is completed, whichever occurs first in step 270.

After the finisher is unloaded and reset, the override is cancelled and the stack limit is reset to the initial selected value in step 280.

System controller 20 regulates the various functions of the printer 10. The system controller 20 is preferably a programmable controller, which controls printer functions hereinbefore described. The system controller 20 may provide a comparison count of the copy sheets, the number of documents being recirculated, the number of copy sheets selected by the operator, the stack limit selected by the operator, the size of the stack in each finisher 16, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

While the Figures show one example of a printer 10 incorporating the user interface 18 and control system 20, it is understood that this process could be used in any printing system.

Although the printer, user interface and method have been described in detail with reference to a certain embodiment, variations and modifications exist within the scope and spirit of the present disclosure as described and defined in the following claims.

What is claimed is:

1. A printing apparatus comprising:

a print engine for fixing an image onto a substrate forming a hard copy;

at least one finishing module for preparing and arranging a series of hard copies into sets for removal by a user, the finishing module including a control subsystem connected to a main electronic control system, the finishing module having a physical capacity but being operable at a user selectable limit capacity that is less than or equal to the physical capacity; and a control module including the main electronic control system having a user interface, the control module being configured to monitor an actual capacity in the finishing module and to compare the actual capacity to an active limit capacity that is one of either the limit capacity selected by a user or an override limit capacity, and the control module generates interactive visual information for displaying on a display of the user interface, the interactive visual information including:

a limit capacity selection screen in which the user can select a limit capacity;

an override screen in which the user can select an override limit capacity that is greater than the selected limit capacity and equal to or less than the physical capacity; and an override prompt screen in which the user can select to change an active limit capacity from the selected limit capacity to the override limit capacity.

2. The printing apparatus of claim 1 wherein said main electronic control system includes a visual information storage section.

3. The printing apparatus of claim 1 wherein the user interface is a graphical user interface.

4. The printing apparatus of claim 1 wherein the control module further comprises a sensor for sensing the actual capacity of the finishing module.

5. The printing apparatus of claim 4 wherein the control module further comprises a processor and the sensor is coupled to the processor.

6. The printing apparatus of claim 1 wherein the interactive visual information displayed on the user interface further comprises:

an icon of the finishing module.

7. The printing apparatus of claim 6 wherein the user interface display displays information for the finishing module when the finishing module icon on the display is selected and the information displayed upon the selected finishing module icon is user-changeable.

8. The printing apparatus of claim 7 wherein changes by the user to the displayed information are transmitted to the control module.

9. A method of operating a printer having finisher module comprising:

selecting an operational capacity limit for a finisher module of a printer, the operational capacity limit being less than a physical capacity of the finisher module;

monitoring an actual level of material in the finisher module during operation of the printer;

comparing the monitored actual level to the selected operational capacity limit;

generating a prompt for an override of the selected operational capacity in response to the monitored actual level approaching the selected operational capacity; and selecting an override operational capacity that is greater than the selected operational capacity and less than or equal to the physical capacity in response to the generated override prompt.

10. The method of claim 9 the prompt generation includes displaying a message on a user interface of the printer.

11. The method of claim 10 the selection of the selected operational capacity includes selecting from a plurality of preset operational capacities.

12. The method of claim 11 the selection of the operational override capacity includes selecting a default override operational capacity associated with the selected operational capacity.

13. The method of claim 9 the selection of the selected operational capacity includes selecting from a plurality of preset operational capacities.

14. The method of claim 9 the selection of the operational override capacity includes selecting a default override operational capacity associated with the selected operational capacity.

15. A user interface for a printer comprising:

a display for communication information regarding printer options;

operational capacity options for a finishing device communicated on the display for selection of an operational capacity;

an override option generated on the display in response to a monitored capacity of the finishing device approaching the selected operational capacity; and override operational capacity limit options generated on the display in response to the override option being selected, the override operational capacity limit options identifying at least one operational capacity limit option that is greater than the selected operational capacity and less than a physical capacity for the finishing device.

16. The user interface of claim 15 further comprising an icon of the finishing device generated on the display and information regarding the finishing device is displayed in response to selection of the finishing device icon.

17. The user interface of claim 16 the information displayed upon selection of the finishing device icon includes the operational capacity limit options, the override option, and the override operational capacity options.

18. The user interface of claim 17 further comprising:

a controller configured to control the operation of the finishing device, and user interface and the options selected by a user are transmitted to the controller.

19. The user interface of claim 18 further comprising:

an actual capacity of the finishing device that is generated in response to the finishing device icon being selected.

* * * * *